United States Patent [19]

Redmore et al.

[11] 4,168,292

[45] Sep. 18, 1979

[54] ACYLATED HYDROXYALKYLAMINOALKYLAMIDES AND PREPARATION THEREOF AND USES THEREOF AS CORROSION INHIBITORS

[75] Inventors: Derek Redmore, Ballwin; Benjamin T. Outlaw, Webster Groves; Delbert C. Scranton, Jr., St. Louis, all of Mo.

[73] Assignee: Petrolite Corporation, St. Louis, Mo.

[21] Appl. No.: 845,685

[22] Filed: Oct. 26, 1977

[51] Int. Cl.[2] ..... C07C 83/10; C23F 11/04; C23F 11/06; C23F 11/14

[52] U.S. Cl. ..... 422/12; 422/13; 422/16; 260/559 A; 260/561 A; 252/8.55 E; 252/392

[58] Field of Search ..... 21/2.5 R, 2.7 R; 260/561 A, 561 K, 559 A; 252/390, 392, 8.55 E; 422/12, 13, 16

[56] References Cited

U.S. PATENT DOCUMENTS

| | | | |
|---|---|---|---|
| 3,455,987 | 7/1969 | Freifelder | 260/559 A |
| 3,714,249 | 1/1973 | Norton | 260/558 A |
| 3,801,562 | 4/1974 | Benneville | 260/561 A |
| 3,904,635 | 9/1975 | Senoo et al. | 260/561 A |
| 3,954,873 | 5/1976 | Gipson | 252/392 |
| 4,060,553 | 11/1977 | Redmore et al. | 260/559 A |

*Primary Examiner*—Morris O. Wolk
*Assistant Examiner*—Bradley Garris
*Attorney, Agent, or Firm*—Sidney B. Ring; Hyman F. Glass

[57] ABSTRACT

Acylated hydroxyalkylaminoalkylamides, the N-alkylated derivatives thereof, and the preparation thereof and uses thereof as corrosion inhibitors.

36 Claims, No Drawings

ACYLATED HYDROXYALKYLAMINOALKYLAMIDES AND PREPARATION THEREOF AND USES THEREOF AS CORROSION INHIBITORS

In U.S. Pat. No. 3,714,249 there is disclosed and claimed hydroxyalkylaminoalkylamides as illustrated by the formula

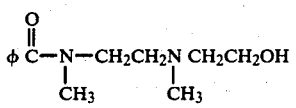

which is prepared from benzonitrile and N-methyl aminoethanol by the process of claim 3 of U.S. Pat. No. 3,714,249 which is as follows.

"3. A process for preparing a hydroxyalkylaminoalkylamide by reacting under anhydrous conditions in the absence of a catalyst, (a) a nitrile of structure $R_1(CN)_n$ where $R_1$ is selected from the group of alkyl of 1 to 10 carbon atoms, alkylene of two to 10 carbon atoms, phenyl, naphthyl, phenylene, lower alkyl substituted phenyl of from seven to 12 carbon atoms, phenylalkyl of seven to 12 carbon atoms, and lower alkyl substituted phenylene of from seven to 12 carbon atoms, and n is a small integer of from one to three, with (b) an alkanolamine of structure

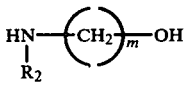

where $R_2$ is H or lower alkyl and m is an integer of 2 to 4, said reaction being conducted at a temperature of from about 100° to about 200° C., at essentially atmospheric pressure, and at a mole ratio of alkanolamine per nitrile group exceeding 2 to 1, but less than about 20:1"

Two moles of alkanolamine will react with a nitrile to form novel linear hydroxyalkylaminoalkylamides having the structure

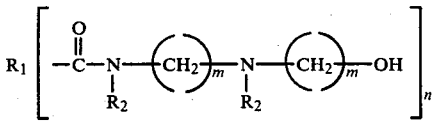

where $R_1$ is an alkyl, alkylene, aryl, aralkyl, or a lower alkyl substituted aryl group, $R_2$ is H or lower alkyl, m is an integer of from 2 to 4 and n is a small integer of from about 1 to about 6, preferably 1 to 3. In accord with the process of the invention these compounds are made by reacting under anhydrous conditions in the absence of a catalyst, a nitrile of structure $R_1—(CN)_n$ with an alkanolamine of structure

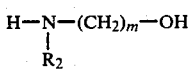

where $R_1$, $R_2$, m and n are above defined, said reaction being conducted at a temperature of from about 100° to about 220° C., at essentially atmospheric pressure and at a mole ratio of alkanolamine per nitrile group exceeding 2 to 1.

Examples of useful nitriles include alkyl nitriles such as acetonitrile, propionitrile, n-butyronitrile, isobutyronitrile, and the like; alkylene dinitriles such as malononitrile, succinonitrile, glutaronitrile, adiponitrile and the like, aromatic nitriles such as benzonitrile, toluonitrile, terephthalonitrile, isophthalonitrile, 1-cyanonaphthalene, 1,5-dicyanonaphthalene and the like. Aralkyl nitriles such as phenylacetonitrile, 1-naphthaleneacetonitrile, gamma-phenylbutryonitrile, and the like are also useful. Preferably, when $R_1$ is an alkyl or alkylene group it will contain from two to ten carbon atoms. When $R_1$ is an aryl, aralkyl, or lower alkyl substituted aryl group it will contain, preferably, from seven carbon atoms (e.g., benzonitrile) to twelve carbon atoms (e.g., 1,5-dicyanononaphthalene). Preferred nitriles are the mono and dinitriles of the benzene series.

Useful alkanolamines include hydroxyethylamine (ethanolamine), 2-amino-1-propanol, hydroxybutylamine, 3-hydroxypropylamine, N-methylethanolamine, N-ethylethanol-amine, and the like. The $R_2$ substituent on the alkanolamine will usually be an alkyl group having no more than about six carbon atoms.

In carrying out the reaction of the invention, the nitrile and alkanolamine are simply mixed and heated to reaction temperature, i.e., from about 100° to about 220° C., and when reaction temperature for the particular combination of reactants is reached, ammonia is evolved. The reaction is conducted at atmospheric pressure, under anhydrous conditions and in the absence of any catalyst. While it is possible to carry out the reaction in certain solvent systems, solvents are not necessary. However, certain polar solvents such as dioxane, pyridine, the dimethylether of ethylene glycol and the like are very useful in that they permit reaction to occur at reflux and also permit easy solvent removal from the product by distillation. Other solvents such as dimethylsulfoxide, dimethylformamide, dimethylacetamide, and the like are also operable, but may be troublesome in hampering product recovery. Non-polar solvents such as aromatic hydrocarbons and high boiling aliphatic compounds are not useful as a reaction medium.

It has been observed that if anhydrous conditions are not maintained, the reaction product contains only one alkanolamine moiety per cyano group instead of two. As indicated, the process requires that the mole ratio of alkanolamine to nitrile function exceed 2 to 1 and preferably will be between about 5:1 to 10:1. For practical purposes this ratio will not normally exceed about 20:1.

Completion of reaction is readily determined by cessation of ammonia evolution (one mole of ammonia is evolved for each cyano group). The reaction mass is worked up by any conventional procedure to recover the product. This is conveniently done by first vacuum distilling off excess alkanolamine and recovering the residue product by standard crystallization procedures. Conventional separation procedures are also useful where the linear hydroxyalkylaminoalkylamide product is mixed with any by-products of the reaction.

The hydroxyalkylaminoalkylamide products are white or wax-like solids having sharp melting points. They are generally insoluble in the usual organic solvents at room temperature, but have sufficient solubility at elevated temperatures to make them responsive to purification procedures by crystallization. Water solubility of the compounds is essentially complete at all proportions and such aqueous solutions show strong surfactant properties.

Examples of typical compounds of the invention include the mono- and bis-amide compounds such as 2-hydroxy-ethylaminoethylbenzamide of structure $$C_6H_5CONHCH_2CH_2NHCH_2CH_2OH,$$

2-hydroxyethylaminoethyltoluamide, 2-hydroxypropylaminopropylbenzamide, bis(2-hydroxyethylaminoethyl) terephthalamide of structure $$C_6H_4(CONHC_2H_4\overset{H}{N}C_2H_4OH)_2,$$

2-hydroxyethylaminoethylacetamide, 2-hydroxyhexylaminohexylbutyramide, and the like.

In application Ser. No. 684,711 of Redmore and Outlaw, filed May 10, 1976, now U.S. Pat. No. 4,060,553, granted Nov. 29, 1977, the reaction of U.S. Pat. No. 3,714,249 has been extended to include the reaction product of unsaturated nitriles with N-alkylalkanolamines to form similar compounds where in addition the N-alkylalkanolamine also reacts with the double bond of the unsaturated nitrile to form an N,N'-di(alkylalkanol). This is illustrated by the following equation:

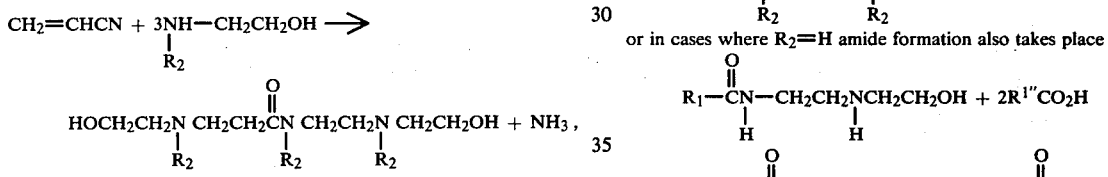

This product can then be mono- or dialkylated.

Thus, instead of a reaction with 2 moles of N-alkylethanolamine with 1 mole of nitrile, acrylonitrile reacts with 3 moles of N-alkylethanolamine.

In addition to acrylonitrile, the following types of unsaturated nitriles can also be employed in the reaction $$R'CH{=}C(R'')-CN$$

where R' and R'' are hydrogen or a substituted group for example alkyl, aryl, cycloalkyl, alkaryl, aralkyl, etc. Typical examples include $$CH_2{=}C(R'')-CN$$

where R'' is alkyl, preferably methyl, such as methacrylonitrile $$\phi CH{=}CH-CN$$

where $\phi$ is an aryl group preferably phenyl such as cinnamonitrile.

As will be seen from the above, the unsaturated nitriles contemplated are $\alpha,\beta$-ethylenically unsaturated.

The $R_2$ group of the alkanolamine can be substituted alkyl group. For example, $R_2$ may be another alkanol group such as dialkanolamines, such as diethanolamines $HN(CH_2CH_2OH)_2$.

We have now discovered that the compositions of U.S. Pat. No. 3,714,249, having the formula $$R_1C(=O)-N(R_2)-A-N(R_2)-AOH,$$

where $R_1$ is the moiety of the original nitrile, e.g. alkyl, alkylene, aryl, aralkyl or a lower alkyl substituted aryl group, $R_2$ is hydrogen or a substituted group and A is alkylene, and the compositions of Ser. No. 684,711 can be acylated with a wide variety of carboxylic acids, preferably fatty acids, or derivatives of carboxylic acids which act as carboxylic acid equivalents such as esters, etc. and that the resulting acylated compositions are particularly useful as corrosion inhibitors particularly where enhanced oil solubility is desired.

The chemistry of acylation may be presented as follows:

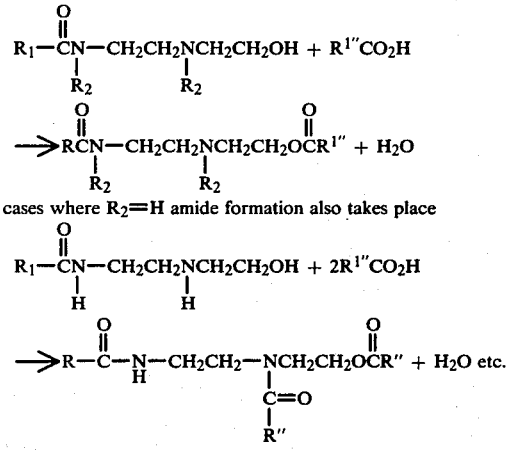

Although a wide variety of carboxylic acids produce excellent products, carboxylic acids having more than six carbon atoms and less than 40 carbon atoms but preferably 8–30 carbon atoms give most advantageous products. The most common examples include the detergent forming acids, i.e., those acies which combine with alkalies to produce soap or soap-like bodies. The detergent-forming acids, in turn, include naturally-occurring fatty acids, resin acids, such as abietic acid, naturally-occurring petroleum acids, such as naphthenic acids, and carboxy acids, produced by the oxidation of petroleum. As will be subsequently indicated, there are other acids which have somewhat similar characteristics and are derived from somewhat different sources and are different in structure, but can be included in the broad generic term previously indicated.

Suitable acids include straight chain and branched chain, saturated and unsaturated, aliphatic, alicyclic, fatty, aromatic, hydroaromatic,, and aralkyl acids, etc.

Examples of saturated aliphatic monocarboxylic acids are acetic, propionic, butyric, valeric, caproic, heptanoic, caprylic, nonanoic, capric, undecanoic, lauric, tridecanoic, myristic, pentadecanoic, palmitic, heptadecanic, stearic, nonadecanoic, eicosanoic, heneicosanoic, docosanoic, tricosanoic, tetracosanoic, pentacosanoic, cerotic, heptacosanoic, montanic, nonacosanoic, melissic and the like.

Examples of ethylenic unsaturated aliphatic acids are the pentenoic acids, the hexenoic acids, for example, obtusilic acid, the undecenoic acids, the dodencenoic acids, for example, lauroleic, linderic, etc., the tridecenoic acids, the tetradecenoic acids, for example, myristoleic acid, the pentadecenoic acids, the hexadecenoic acids, for example, palmitoleic acid, the heptadecenoic acids, the octodecenoic acids, for example, petrosilenic acid, oleic acid, elardic acid, the nonadecenoic acids, for example, the eicosenoic acids, the docosenoic acids, for example, erucic acid, brassidic acid, cetoleic acid, the tetradosenic acids, and the like.

Examples of dienoic acids are the pentadienoic acids, the hexadienoic acids, for example, sorbic acid, the octadienoic acids, for example, linoleic, and the like.

Examples of the cyclic aliphatic carboxylic acids are those found in petroleum called naphthenic acids, hydrocarbic and chaumoogric acids, cyclopentane carboxylic acids, cyclohexanecarboxylic acid, campholic acid, fenchlolic acids, and the like.

Examples of aromatic monocarboxylic acids are benzoic acid, substituted benzoic acids, for example, the toluic acids, the xyleneic acids, alkoxy benzoic acid, phenyl benzoic acid, naphthalene carboxylic acid, and the like.

Mixed higher fatty acids derived from animal or vegetable sources, for example, lard, cocoanut oil, rapeseed oil, sesame oil, palm kernel oil, palm oil, olive oil, corn oil, cottonseed oil, sardine oil, tallow, soybean oil, peanut oil, castor oils, whale oil, shark oil, and other fish oils, teaseed oil, partially or completely hydroginated animal and vegetable oils are advantageously employed. Fatty and similar acids include those derived from various waxes, such as beeswax, spermaceti, montan wax, Japan wax, coccerin and carnauba wax. Such acids include carnaubic acid, cerotic acid, lacceric acid, montanic acid, psyllastearic acid, etc. One may also employ higher molecular weight carboxylic acids derived by oxidation and other methods, such as from paraffin wax, petroleum and similar hydrocarbons; resinic and hydroaromatic acids, such as hexahydrobenzoic acid, hydrogenated naphthoic, hydrogenated carboxyl diphenyl, naphthenic, and abietic acid; Twitchell fatty acids, carboxydiphenyl pyridine carboxylic acid, blown oils, blown oil fatty acids and the like.

Other polycarboxylic acids are the dimeric, trimeric, and polymeric acids, for example, dilinoleic, trilinoleic, and other polyacids sold by Emery Industries, and the like. Other polycarboxylic acids include those containing ether groups, for example, diglycolic acid. Mixtures of the above acids can be advantageously employed.

In addition, acid precursors such as acid anhydrides, esters, acid halides, glycerides, etc., can be employed in place of the free acid.

The following examples are presented to illustrate the preparation of the hydroxyalkylaminoalkylamides.

EXAMPLE 1

Benzonitrile (58.7 g, 0.57 mole) and 2-(methylamino)-ethanol (129 g, 1.72 mole) were stirred at 150°-180° (reflux) for 30½ hrs. under a continuous sweep of Nitrogen. Evolution of $NH_3$ was evident during the reaction. The resulting mixture was distilled under vacuum to remove the excess amine. The viscous reaction product (115.4 g) was found to have the structure

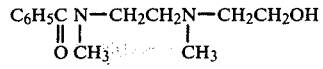

which in hydrolysis yields benzoic acid and the amine,

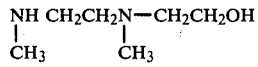

EXAMPLE 2

Benzonitrile (34.3 g, 0.33 mole) and diethanolamine (105.1 g, 1 mole) were stirred at 150°-180° for 26 hrs. Anhydrous conditions were maintained by a continuous nitrogen sweep. Strong evolution of $NH_3$ was evident during the course of the reaction. The resulting mixture was distilled under vacuum to remove excess amine yielding 84.2 g of viscous oil. The structure of the product is:

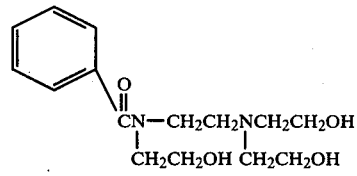

EXAMPLE 3

Benzonitrile (103 g, 1 mole) and monoethanolamine (183.3 g, 3 mole, $R_2$=H) were stirred at 150°-180° for 27 hrs. under anhydrous conditions (via $N_2$ sweep) with rapid evolution of $NH_3$. The excess monoethanolamine was removed by vacuum distillation to yield 195.1 g of viscous oil. The product is largely:

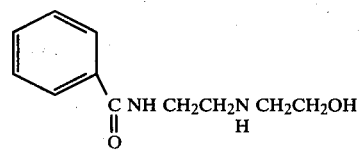

EXAMPLE 4

Acrylonitrile (35.3 g, 0.67 mole) was added slowly (15 min) to 2-(methylamino)-ethanol (150.2 g, 2 mole). The exothermic reaction was maintained at 50° by a water bath. After stirring at room temp. for 30 min. the mixture was heated at 150°-180° for 47 hrs. Distillation under vacuum yielded only 5 g of excess amine leaving 112.5 g of viscous product.

The product was shown to be

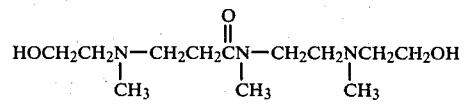

by hydrolysis with 10% sodium hydroxide solution which yielded

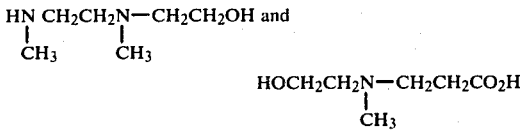

EXAMPLE 5

Acrylonitrile (16.8 g, 0.32 mole) was added to diethanolamine (100 g, 0.95 mole) with an exothermic reaction occurring that was controlled at 50° by water bath cooling. After stirring the resulting mixture for 15 min. at room temperature it was heated at 150°–180° for 25 hrs. Vacuum distillation of the reaction product gave only 6 g of excess amine and 82.9 g of a viscous oil.

The structure was shown to be

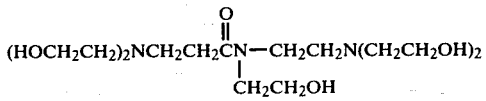

by hydrolysis.

EXAMPLE 6

Acrylonitrile (43.5 g, 0.82 mole) was added to monoethanolamine (150 g, 2.45 mole) with water bath cooling to control the exothermic reaction. After stirring the resulting mixture at room temperature for 30 min. it was heated at 150°–180° for 9 hrs. to yield 51.8 g of viscous oil after removal of slight excess of amine.

The product is mainly

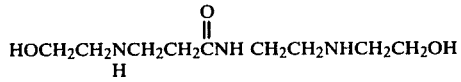

EXAMPLE 7

Acrylonitrile (11.25 lbs) was slowly added at 50° C. to monoethanolamine (27–25 lbs) with stirring and cooling as necessary. The mixture was then heated to 165° and maintained for 6 hrs. while ammonia was evolved.

Vacuum was applied to remove volatiles and 7 lbs was collected. Yield of product was 30.25 lbs. giving the following analysis: Nitrogen total 18.17%, Nitrogen basic 12.9%.

The following examples describe the preparation of fatty acid derivatives of the alkanolamine/nitrile condensates.

EXAMPLE 8

To the condensate of Example 1 (23.6 g) was added Crofatol-P (a Tall oil distilled, Crosby) (29 g) and the mixture heated at reflux in xylene using a Dean and Stark tube to collect water. After heating at reflux for 7 hrs. 2 g of water had been collected and the esterification was complete.

EXAMPLE 9

The condensate of Example 3 (20.8 g) was heated with a crude tall oil acid (34 g) in xylene at reflux for 24 hrs. During this heating 2.2 ml of water was collected as the esterification reaction was completed.

EXAMPLE 10

The condensate of Example 6 (43.8 g) was heated with a crude tall oil acid (86 g) in xylene until 14 g of distillate had been collected (6 hrs). The distillate contained water and some ethanolamine.

EXAMPLE 11

This example illustrates a different ratio of the reactants used in Example 9.

The condensate of Example 6 (43.8 g), crude tall oil acid (68 g) and xylene were heated at reflux for 24 hrs during which time 15 g of aqueous condensate was collected.

EXAMPLE 12

The condensate of Example 6 (54.8 g) was heated in xylene with Crofatol P (72.5 g) for 24 hrs until water removal was complete yielding a viscous ester product.

EXAMPLE 13

The reactants of Example 11 were combined in different ratio; the condensate of Example 6 (47.4 g) was heated in xylene with Crofatol P (87 g) for 6 hours with collection of 6.7 g distillate.

EXAMPLE 14

The condensate of Example 7 (50 g) and Crofatol P (100.6 g) were heated at reflux in xylene for 6 hours during which time 4.8 g of water was collected and esterification was complete.

EXAMPLE 15

This product was prepared by the method of Example but on a larger scale (15 gallon reactor) to allow field trials. Analysis of the product gave Nitrogen total 4.50%, basic 1.34%, Acid number 180 and saponification value 42.

USE AS A CORROSION INHIBITOR

This phase of the invention relates to the prevention of corrosion in systems containing a corrosive medium, and most particularly in oily systems such as encountered in primary production.

In general, a minor but effective amount of the products of this invention are employed to inhibit corrosion such as at least about 5 ppm, such as from about 1 to 5000 ppm, for example, from about 1 to 1000 ppm, but preferably from about 1 to 500 ppm.

The products of Examples 8–15 were blended with dimer acid (dimers of oleic acid or linoleic acids) and solvents prior to corrosion tests as follows:

| | |
|---|---|
| Condensate (Examples 8–15) | 30% |
| Dimer Acid | 12% |
| Methanol | 5% |
| Aromatic hydrocarbon solvent | 53% |

These blends are referred to as Examples 8B–15B in the following table of corrosion test results.

The following examples illustrate the use of the compositions of this invention as corrosion inhibitors.

Conditions:

5% NaCl Solution

Atm. Pressure

Room Temperature

Constant $CO_2$ Sparge (Coleman Instrument Grade)

Constant Stirring
250 p.p.m. of inhibitor based on active component

| Compound | Corrosion Rate | (hrs) | Protection |
|---|---|---|---|
| Example 8B | 0.5 mpy | 18 hrs. | 99.5% |
| Example 9B | 1.0 mpy | 18 hrs. | 99% |
| Example 10B | 1.5 mpy | 18 hrs. | 98.5% |
| Example 11B | 3.0 mpy | 18 hrs. | 97% |
| Example 12B | 1.8 mpy | 18 hrs. | 98.2% |
| Example 13B | 0.9 mpy | 18 hrs. | 99.1% |
| Example 14B | 0.8 mpy | 17 hrs. | 99.2% |
| Example 15B | 8.0 mpy | 4 hrs. | 93.4% |
| Example 15B | 3.0 mpy | 18 hrs. | 96.8% |

Field Test Results

A field test was carried out on two wells A and B. Corrosion protection had been monitored carefully by weight loss coupons (obviously metals and/or metal alloys) for an extended period of treatment with a commercial inhibitor. This treatment involved weekly treatment with 2 gallons of inhibitor.

| Well Data | | | |
|---|---|---|---|
| Well A | Production | 42 barrels oil per day | |
| | | 127 barrels water per day | |
| Well B | Production | 94 barrels oil per day | |
| | | 172 barrels water per day | |
| Well A | Average corrosion rate for an extended period | | 1.8 mpy |
| Well B | Average corrosion rate for an extended period | | 1.15 mpy |

These wells were then treated weekly with compositions of Example 15B, 1.7 gallons, with the following results:

Well A—Corrosion rate 0.07 mpy
Well B—Corrosion rate 0.11 mpy.

We claim:

1. An acylated hydroxyalkylaminoalkylamide, said hydroxyalkylaminoalkylamide being prepared by reacting about 1 mole of an $\alpha,\beta$-ethylenically unsaturated nitrile with about 3 moles of an alkanolamine so that one mole of said alkanolamine reacts at the ethylenic bond to form an N-alkanol group and the other 2 moles react with the nitrile group to form a hydroxyalkylaminoalkylamide group, and said acylated hydroxyalkylaminoalkylamide being prepared by reacting said hydroxyalkylaminoalkylamide with a carboxylic acid or carboxylic acid precursor.

2. A process of inhibiting corrosion of metals and metal alloys which comprises adding to a system containing a corrosive liquid medium a corrosion inhibiting amount of an acylated hydroxyalkylaminoalkylamide of claim 1.

3. The acylated hydroxyalkylaminoalkylamide of claim 1, wherein said carboxylic acid has more than six and less than 40 carbon atoms.

4. A process of inhibiting corrosion of metals and metal alloys which comprises adding to a system containing a corrosive liquid medium a corrosion inhibiting amount of an acylated hydroxyalkylaminoalkylamide of claim 3.

5. The acylated hydroxyalkylaminoalkylamide of claim 1, wherein said carboxylic acid is a detergent forming acid.

6. A process of inhibiting corrosion of metals and metal alloys which comprises adding to a system containing a corrosive liquid medium a corrosion inhibiting amount of an acylated hydroxyalkylaminoalkylamide of claim 5.

7. The acylated hydroxyalkylaminoalkylamide of claim 1, wherein said $\alpha,\beta$-ethylenically unsaturated nitrile has the formula

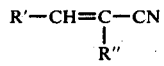

where R′ and R″ are hydrogen, alkyl, aryl, cycloalkyl, alkaryl or aralkyl.

8. A process of inhibiting corrosion of metals and metal alloys which comprises adding to a system containing a corrosive liquid medium a corrosion inhibiting amount of an acylated hydroxyalkylaminoalkylamide of claim 7.

9. The acylated hydroxyalkylaminoalkylamide of claim 1 where the unsaturated nitrile is an arylnitrile.

10. The acylated hydroxyalkylaminoalkylamide of claim 9 where the arylnitrile is $\phi CH{=}CH{-}CN$.

11. A process of inhibiting corrosion of metals and metal alloys which comprises adding to a system containing a corrosive liquid medium a corrosion inhibiting amount of an acylated hydroxyalkylaminoalkylamide of claim 9.

12. A process of inhibiting corrosion of metals and metal alloys which comprises adding to a system containing a corrosive liquid medium a corrosion inhibiting amount of an acylated hydroxyalkylaminoalkylamide of claim 10.

13. The acylated hydroxyalkylaminoalkylamide of claim 1 where the unsaturated nitrile is an acrylonitrile or a substituted acrylonitrile.

14. A process of inhibiting corrosion of metals and metal alloys which comprises adding to a system containing a corrosive liquid medium a corrosion inhibiting amount of an acylated hydroxyalkylaminoalkylamide of claim 13.

15. The acylated hydroxyalkylaminoalkylamide of claim 13 where the unsaturated nitrile is acrylonitrile.

16. A process of inhibiting corrosion of metals and metal alloys which comrises adding to a system containing a corrosive liquid medium a corrosion inhibiting amount of an acylated hydroxyalkylaminoalkylamide of claim 15.

17. Acylated hydroxyalkylaminoalkylamide of claim 15 where the hydroxyalkylaminoalkylamide subjected to acylation has the formula

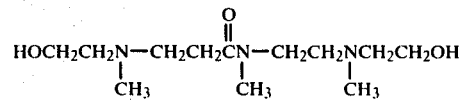

18. A process of inhibiting corrosion of metals and metal alloys which comprises adding to a system containing a corrosive liquid medium a corrosion inhibiting amount of an acylated hydroxyalkylaminoalkylamide of claim 17.

19. Acylated hydroxyalkylaminoalkylamide of claim 15 where the hydroxyalkylaminoalkylamide subjected to acylation has the formula $$HOCH_2CH_2\overset{H}{N}\,CH_2CH_2\overset{\overset{O}{\|}}{C}\,\overset{H}{N}\,CH_2CH_2NCH_2CH_2OH$$

20. A process of inhibiting corrosion of metals and metal alloys which comprises adding to a system containing a corrosive liquid medium a corrosion inhibiting amount of an acylated hydroxyalkylaminoamide of claim 19.

21. An acylated hydroxyalkylaminoalkylamide, prepared by reacting a hydroxyalkylaminoalkylamide having the formula $$R_1-\overset{\overset{O}{\|}}{C}-\overset{\overset{R_2}{|}}{N}-A-\overset{\overset{R_2}{|}}{N}-AOH$$

where $R_1$ is alkyl, alkylene, aryl, aralkyl or a lower alkyl substituted group, $R_2$ is hydrogen or a substituted group and A is alkylene, with a carboxylic acid or carboxylic acid precursor.

22. A process of inhibiting corrosion of metals and metal alloys which comprises adding to a system containing a corrosive liquid medium a corrosion inhibiting amount of an acylated hydroxyalkylaminoalkylamide of claim 21.

23. The acylated hydroxyalkylaminoalkylamide of claim 21, wherein said carboxylic acid has more than six and less than 40 carbon atoms.

24. A process of inhibiting corrosion of metals and metal alloys which comprises adding to a system containing a corrosive liquid medium a corrosion inhibiting amount of an acylated hydroxyalkylaminoalkylamide of claim 23.

25. The acylated hydroxyalkylaminoalkylamide of claim 21, wherein said carboxylic acid is a detergent forming acid.

26. A process of inhibiting corrosion of metals and metal alloys which comprises adding to a system containing a corrosive liquid medium a corrosion inhibiting amount of an acylated hydroxyalkylaminoalkylamide of claim 25.

27. The acylated hydroxyalkylaminoalkylamide of claim 21 where $R_1$ is aryl.

28. A process of inhibiting corrosion of metals and metal alloys which comprises adding to a system containing a corrosive liquid medium a corrosion inhibiting amount of an acylated hydroxyalkylaminoalkylamide of claim 27.

29. The acylated hydroxyalkylaminoalkylamide of claim 27 where $R_1$ is phenyl.

30. A process of inhibiting corrosion of metals and metal alloys which comprises adding to a system containing a corrosive liquid medium a corrosion inhibiting amount of an acylated hydroxyalkylaminoalkylamide of claim 29.

31. Acylated hydroxyalkylaminoalkylamide of claim 29 where the hydroxyalkylaminoalkylamide subjected to acylation has the formula

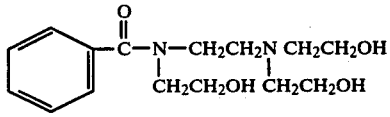

32. A process of inhibiting corrosion of metals and metal alloys which comprises adding to a system containing a corrosive liquid medium a corrosion inhibiting amount of an acylated hydroxyalkylaminoalkylamide of claim 31.

33. Acylated hydroxyalkylaminoalkylamide of claim 29 where the hydroxyalkylaminoalkylamide subjected to acylation has the formula

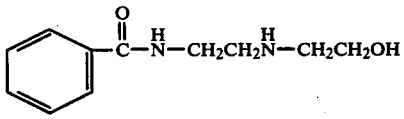

34. A process of inhibiting corrosion of metals and metal alloys which comprises adding to a system containing a corrosive liquid medium a corrosion inhibiting amount of an acylated hydroxyalkylaminoalkylamide of claim 33.

35. Acylated hydroxyalkylaminoalkylamide of claim 29 where the hydroxyalkylaminoalkylamide subjected to acylation has the formula

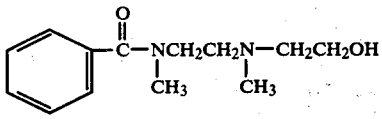

36. A process of inhibiting corrosion of metals and metal alloys which comprises adding to a system containing a corrosive liquid medium a corrosion inhibiting amount of an acylated hydroxyalkylaminoalkylamide of claim 35.

* * * * *